US010418752B2

(12) United States Patent
Choi

(10) Patent No.: US 10,418,752 B2
(45) Date of Patent: Sep. 17, 2019

(54) CONNECTOR AND CONNECTOR ASSEMBLY

(71) Applicant: Molex, LLC, Lisle, IL (US)

(72) Inventor: Young Jun Choi, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/978,401

(22) Filed: May 14, 2018

(65) Prior Publication Data

US 2018/0337490 A1 Nov. 22, 2018

Related U.S. Application Data

(60) Provisional application No. 62/507,965, filed on May 18, 2017.

(30) Foreign Application Priority Data

Oct. 12, 2017 (JP) ..... 2017-198584

(51) Int. Cl.
*H01R 13/627* (2006.01)

(52) U.S. Cl.
CPC ..... *H01R 13/6273* (2013.01)

(58) Field of Classification Search
CPC ..... H01R 13/5271; H01R 13/5275
USPC ..... 439/358, 357
See application file for complete search history.

(56) References Cited

U.S. PATENT DOCUMENTS 4,801,275 A 1/1989 Ikeda et al.
5,336,101 A 8/1994 Kasugai et al.
6,146,183 A * 11/2000 Jinno ..... H01R 13/6272 439/358
6,669,510 B2 * 12/2003 Yamawaki ..... H01R 13/6273 439/357

(Continued)

FOREIGN PATENT DOCUMENTS

CN 1610191 A 4/2005
CN 1658442 A 8/2005

(Continued)

OTHER PUBLICATIONS

Office Action received for Korean application No. 10-2018-0054021, dated Jan. 17, 2019, 11 pages. (6 pages of English Translation and 5 pages of Official Copy).

(Continued)

*Primary Examiner* — Phuong Dinh
(74) *Attorney, Agent, or Firm* — Molex, LLC

(57) ABSTRACT

A lock arm (12) of a first connector (10) includes a locking part including a locking piece (154) that directly engages with a locking projection (22) of a second connector (20), and an operating part (14) including an operating knob (144) to be pressed. The locking part (15) includes locking part coupling arms (153*a* and 153*b*), locking part supporting arms (151*a* and 151*b*), and locking part legs (152*a* and 152*b*) connecting the arms to an upper surface (11*a*) of a first housing 11. The operating part (14) includes an operating part supporting arm (141), operating part coupling arms (143*a* and 143*b*), and an operating part leg (142) connecting the arms to the upper surface (11*a*). The locking part coupling arms (153*a*and 153*b*) and the operating part coupling arms (143*a* and 143*b*) are respectively connected via coupling parts (16*a* and 16*b*). The operating part leg (142) is disposed between the locking part leg (152*a* and 152*b*).

5 Claims, 5 Drawing Sheets

(56) References Cited

U.S. PATENT DOCUMENTS

| | | | | |
|---|---|---|---|---|
| 2012/0064754 | A1* | 3/2012 | Nonen | H01R 13/6271 439/358 |
| 2014/0364001 | A1* | 12/2014 | Kraus | H01R 13/6272 439/358 |

FOREIGN PATENT DOCUMENTS

| | | | |
|---|---|---|---|
| CN | 105914526 | A | 8/2016 |
| JP | H02-54180 | U | 4/1990 |
| JP | H02-20770 | Y2 | 6/1990 |
| JP | H09-50862 | A | 2/1997 |
| JP | 2593897 | Y2 | 4/1999 |
| JP | 2003-308925 | A | 10/2003 |
| KR | 10-2012-0067281 | A | 6/2012 |
| KR | 10-2014-0044918 | A | 4/2014 |
| KR | 10-2016-0102114 | A | 8/2016 |

OTHER PUBLICATIONS

Decision to Grant received for Korean application No. 10-2018-0054021, dated May 28, 2019, 2 pages. (1 page of English Translation and 1 page of Official Copy).

* cited by examiner

CONNECTOR AND CONNECTOR ASSEMBLY

RELATED APPLICATIONS

This application claims priority to U.S. Provisional Application No. 62/507,965, filed May 18, 2017 and to Japanese Application No. 2017-198584, filed Oct. 12, 2017, both of which are incorporated herein by reference in their entirety.

TECHNICAL FIELD

The present disclosure relates to a connector and a connector assembly.

BACKGROUND ART

In order to prevent, when a plug connector and a receptacle connector of a wire-to-wire connector are fitted, for example, the plug connector and the receptacle connector from disengaging unintentionally, a lock structure has been used to restrict the plug connector and the receptacle connector from moving in insertion and extraction directions for secure fitting in the related art. Such a lock structure is known that includes a locking projection formed on a connector housing, and a lock arm formed on another connector housing to engage with the locking projection.

In Patent Document 1, described below, an engaging claw 4 is formed as a locking projection on a connector housing. When the engaging claw 4 engages with a locking piece 7 formed as a lock arm on another housing, a receptacle connector and a plug connector fit and lock to each other. In here, a coupling piece part 11 formed on the locking piece 7 directly engages with the engaging claw 4. The coupling piece part 11 is supported by a support leg 8 and a pair of lock arm parts 10 each extending in the insertion and extraction directions of the connector so as to be swingable relative to the housing of a plug 3. A finger hooking part 17 to be pressed so that the locking piece 7 swings is connected to the coupling piece part 11 with a triangular blade part 14 via a release lever part 16 extending outside the two lock arm parts 10.

Patent Document 1: Japanese Unexamined Publication No. H2-54180

SUMMARY

To fully secure, with a lock structure, a resistance force (i.e., holding force) in an extraction direction to keep a plug connector and a receptacle connector fitted to each other, further improvement in stiffness is required for the lock structure. When a lock arm is operated to unlock and extract a fitted connector, it is required that the lock arm should swing properly to disengage from a locking projection.

In the configuration of Patent Document 1, a coupling piece part, a finger hooking part, and a release lever part, for example, configuring the lock arm are supported on a housing with support legs via only a pair of lock arm parts each extending from the coupling piece part. To fully secure a holding force, it is required that the lock arm part and the support legs be thicker for improvement in stiffness, resulting in a large sized lock structure. In this case, a connector might not be reduced in size. In addition, in the structure in which the finger hooking part is directly connected to the coupling piece via the release lever part, while the housing is not directly supported, the coupling piece might not move stably in an unlocking direction depending on a direction or an angle of a pressing force applied to the finger hooking part. In a case where the coupling piece does not disengage from the engaging piece, and the engagement is not released, unlocking might not be securely achieved.

In view of the above described problems, an object of the present disclosure is to provide a small sized connector with a higher holding force provided through a lock structure including a stiffer lock arm provided on a housing so that a lock arm can properly swing for secure locking and unlocking.

(1) A connector according to an embodiment proposed in the present disclosure includes a lock arm configured to engage with a locking projection provided on a target connector to be inserted and extracted to lock the target connector when fitted. The connector further includes a housing provided with the lock arm, and a terminal accommodated in the housing. The terminal is to be connected to a terminal of the target connector. The lock arm includes a locking part including an engaging part to be engaged with the locking projection of the target connector, and an operating part including a pressing part to be pressed. The locking part further includes a pair of locking part coupling arms respectively extending from the engaging part in a separation direction of the target connector, a pair of locking part supporting arms respectively further extending from the pair of locking part coupling arms in the separation direction of the target connector, and a pair of locking part legs respectively connecting an outer surface of the housing and the pair of locking part supporting arms. The operating part further includes a pair of operating part coupling arms respectively extending from the pressing part in a direction toward the target connector to connect to the pair of locking part coupling arms, an operating part supporting arm connected to the pressing part to extend from between the pair of operating part coupling arms in the direction toward the target connector, and an operating part leg connecting the outer surface of the housing and the operating part supporting arm. The operating part leg is disposed, on the outer surface of the housing, between the pair of locking part legs. The pair of operating part coupling arms are respectively disposed outside the pair of locking part supporting arms.

(2) In the connector described in (1), the operating part supporting leg and the operating part supporting arm may be respectively formed thicker than the locking part legs and the locking part supporting arms.

(3) In the connector described in (1) or (2), the pair of locking part coupling arm parts and the pair of operating part coupling arms may each be formed thicker than the pair of locking part supporting arms.

(4) In any one of the connectors described in (1) to (3), the locking part coupling arms and the locking part supporting arms may be connected to each other such that the locking part supporting arms are thinner than the locking part coupling arms, while, as for the operating part coupling arms and the locking part coupling arms, the locking part coupling arms may be connected to coupling parts each having a length equal to or longer than a width of each of the locking part coupling arms in insertion and extraction directions toward which the target connector is inserted and extracted.

(5) A connector assembly according to an embodiment proposed in the present disclosure includes first and second connectors to be inserted into and extracted from each other. The first connector is any one of the connectors described in (1) to (4) including a lock arm configured to engage with a locking projection provided on the second connector to lock the second connector when fitted. The second connector includes a terminal to be connected to a terminal of the first connector, and a second housing that is provided with the locking projection and that accommodates the terminal of the second connector.

DETAILED DESCRIPTION OF THE PREFERRED EMBODIMENTS

Figure 1:
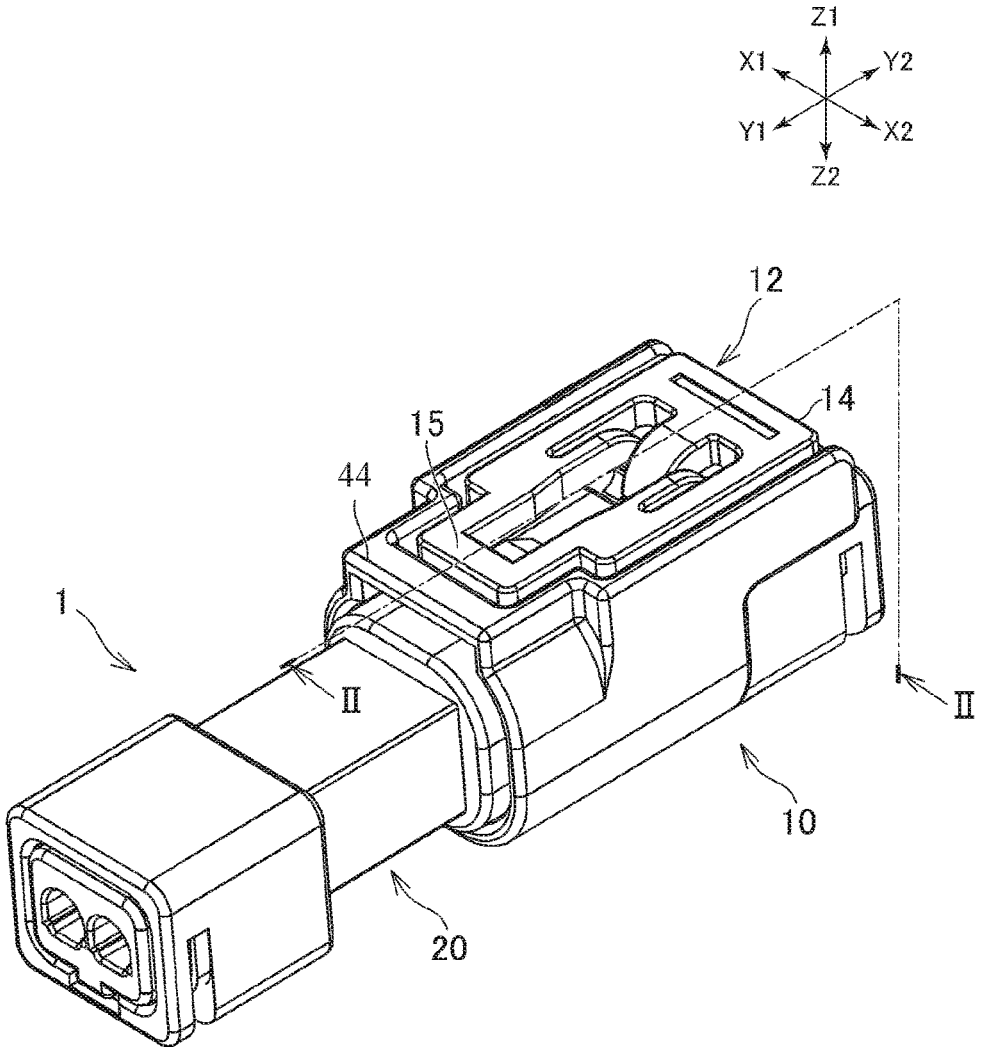
FIG. 1 is a perspective view of a connector being fitted, according to the present disclosure.

An embodiment of a connector and a connector assembly proposed in the present disclosure will now be described herein. However, the present disclosure is not limited to the present embodiments described below, and various modification based on the gist of the present disclosure are possible and are not excluded from the scope of patent claims based on the present disclosure.

In the below description, directions illustrated as Y1 and Y2 in the drawings respectively denote front and rear. The directions respectively represent directions toward which a connector is inserted and extracted. Directions illustrated as Z1 and Z2 in the drawings respectively denote upper and lower. Directions illustrated as X1 and X2 in the drawings respectively denote right and left (and sometimes denote a width direction). Note that the various directions are only used to describe the relative positional relationships of the parts that configure the connector assembly, and thus do not illustrate absolute directions.

Figure 2:
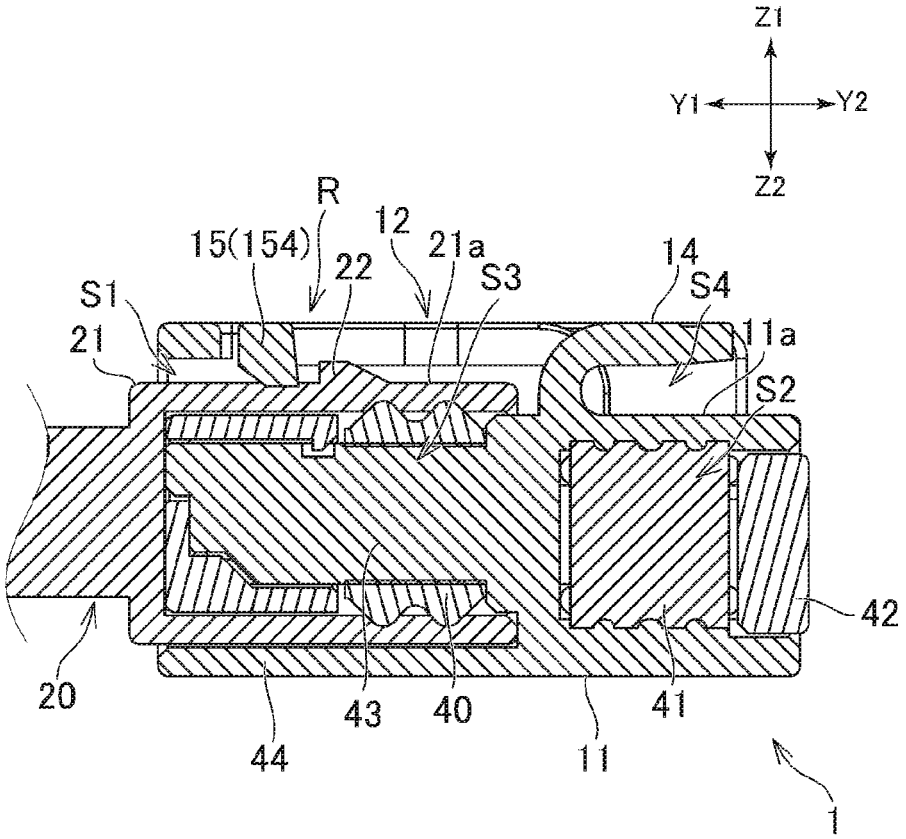
FIG. 2 is a cross-sectional view of the connector taken along the line II-II illustrated in FIG. 1.

As illustrated in FIG. 1, a connector assembly 1 includes a first connector 10 and a second connector 20 (target connector). For example, the first connector 10 may be a receptacle connector, and the second connector 20 may be a plug connector. However, the present disclosure is not necessarily limited to this. As illustrated in FIG. 2, the first connector 10 includes a first housing 11, while the second connector 20 has a second housing 21. The first housing 11 is formed capable of inserting and extracting in a front-rear direction into and from the second housing 21.

As illustrated in FIG. 2, between the first connector 10 and the second connector 20, a connector lock structure R is provided to securely fit the first connector 10 and the second connector 20 so as not to be disengaged unintentionally, i.e., to restrict the first connector 10 and the second connector 20 from separating in an insertion-extraction direction. The connector lock structure R may include a lock arm 12 provided on the first housing 11 of the first connector 10, and a locking projection 22 provided on the second housing 21 of the second connector 20.

As illustrated in FIGS. 1 and 2, the first housing 11 of the first connector 10 may be made of an insulating material, such as resin, and may be wholly formed in an approximately cylindrical shape. At a front side of the first housing 11, a fitting part 43 that fits to the second housing 21, and an outer shell part 44 having an approximately cylindrical shape covering the fitting part 43 may be formed. Between the fitting part 43 and the outer shell part 44, an accommodation space S1 may be formed. The accommodation space S1 opens forward so as to be fitted with the second housing 21.

On the fitting part 43 of the first housing 11, a hole part (not illustrated) passing through in the front-rear direction may be formed. The hole part may accommodate a first terminal (e.g., receptacle terminal, not illustrated) connected with a wire. On the fitting part 43, a fit-sealing member 40 may be attached. The fit-sealing member 40 is formed in a cylindrical shape surrounding the fitting part 43 to prevent water, for example, from entering between the fitting part 43 and the second housing 21.

A rear side of the first housing 11 may also be formed in an approximately cylindrical shape to form an accommodation space S2 opening rearward. Inside the accommodation space S2, a sealing member 41 configured to prevent water, for example, from entering between a cable and the first housing 11 may be accommodated. Behind the sealing member 41, a retaining member 42 configured to prevent the sealing member 41 from coming off may further be attached. On an upper surface 11*a* of the first housing 11, the lock arm 12 may be formed. A configuration of the lock arm 12 will be described later in detail.

The configuration inside the housing, such as the terminal part 41, the terminal sealing member 42, and the fitting part 43, does not directly affect the disclosure of the present application, but may be an ordinary configuration. Therefore, its illustration and description are omitted.

As illustrated in FIGS. 1 and 2, similar to the first housing 11, the second housing 21 of the second connector 20 may be made of an insulating material, such as resin, and may be wholly formed in an approximately cylindrical shape. As illustrated in FIG. 2, a rear side of the second housing 21 may open rearward to internally form an accommodation space S3. The accommodation space S3 may accommodate the fitting part 43 of the first housing 11. The rear side of the cylindrical shape may fit to the first housing 11 so that the fit-sealing member 40, described above, prevent water, for example, from entering. Inside the accommodation space S3, a second terminal (not shown) served as a plug terminal connected with a wire may be accommodated in the front-rear direction so as to fit and connect to the first terminal inside the fitting part 43 of the first housing 11.

The configuration inside the second connector does not also directly affect the disclosure of the present application, but may be an ordinary configuration. Therefore, its illustration and description are omitted.

On an upper surface 21*a* of the second housing 21, the locking projection 22 projecting upward may be formed. The locking projection 22 may engage with the lock arm 12 to lock the first connector and the second connector. A rear side of the locking projection 22 may have an inclined surface, while a front side may have a vertically uprising surface from the upper surface 21*a*.

The first housing 11 and the second housing 21 have been described. However, the present disclosure is not necessarily limited to the shapes, the components, and the arrangement of the components, as described above. For example, the embodiment is formed in a left-right symmetry shape. However, the embodiment may be formed in a left-right asymmetry shape. Either or both of the lock arm 12 and the locking projection 22 respectively formed on the upper surface 11*a* and the upper surface 21*a* of the housings may also be formed on an outer surface, such as a lower surface and left and right surfaces. When a plurality of the lock arms 12 are formed on the first housing 11, the second housing 21 may be formed with a plurality of the locking projections 22 at corresponding engagement positions.

Figure 3:
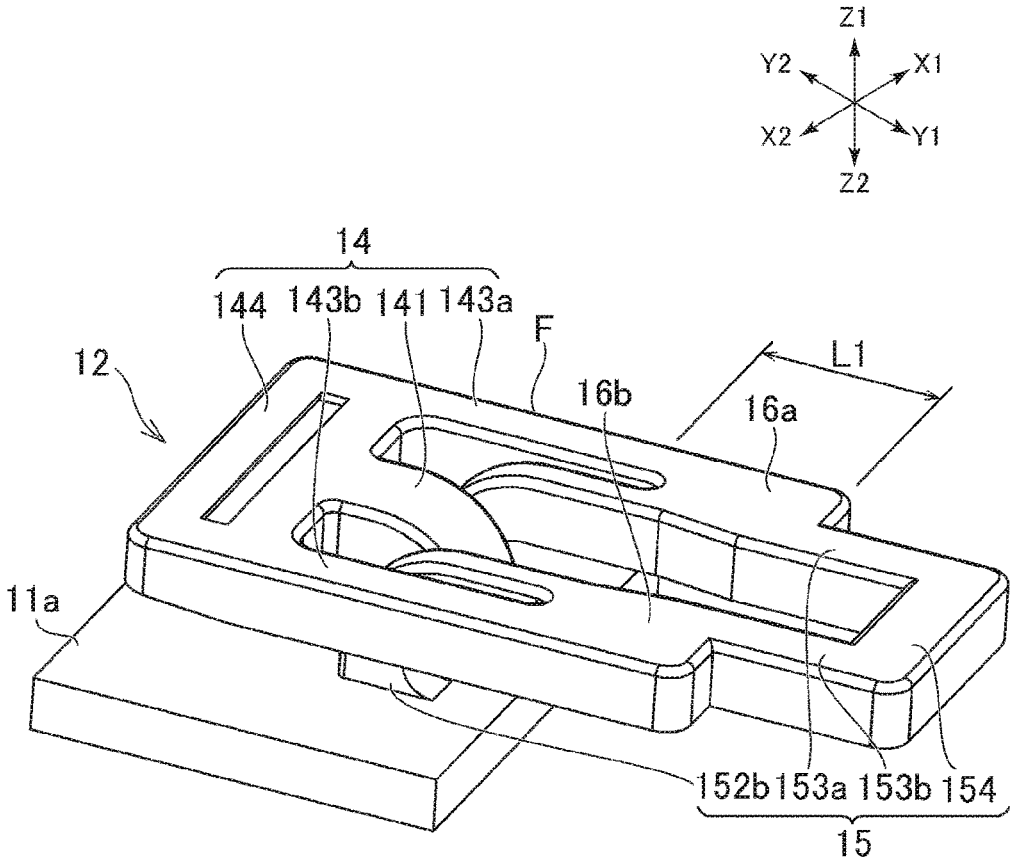
FIG. 3 is a perspective view of a lock arm representing a lock structure of the connector according to the present disclosure.
Figure 4:
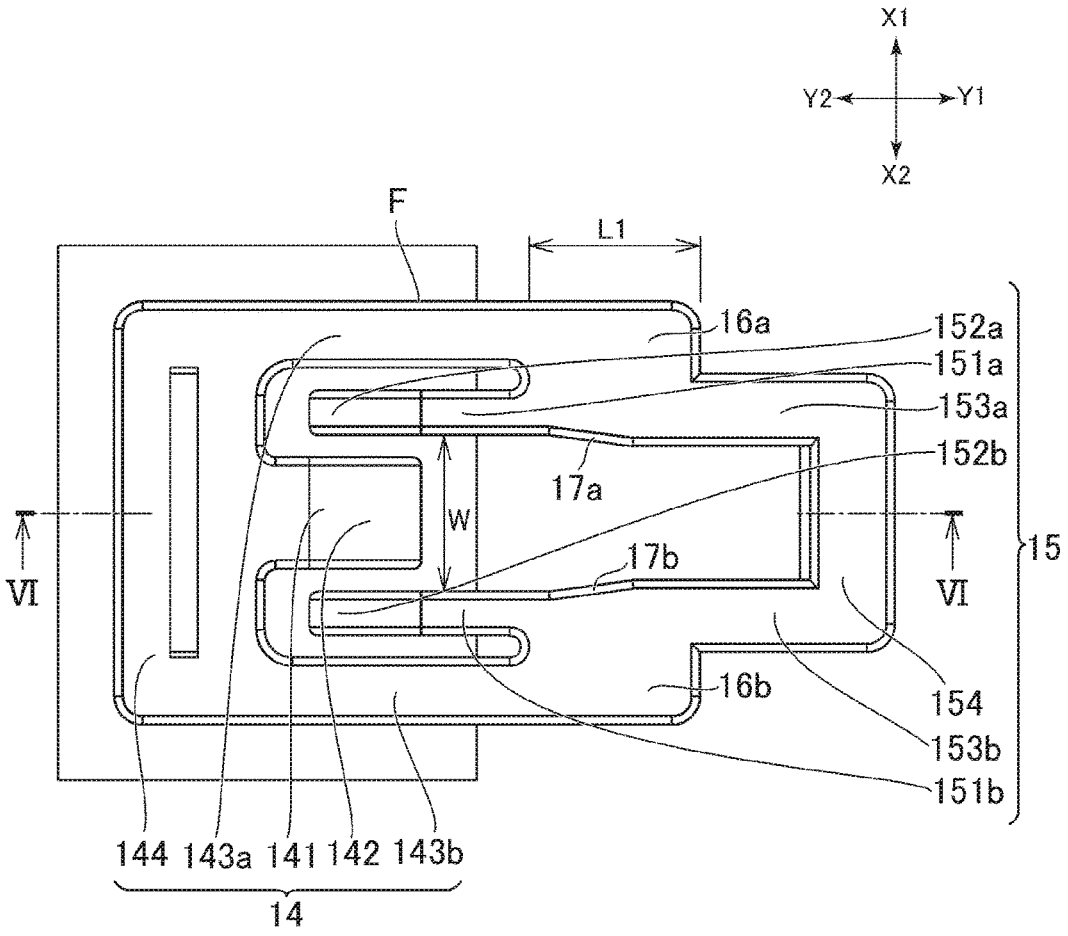
FIG. 4 is a plan view of the lock arm representing the lock structure of the connector according to the present disclosure.

As illustrated in FIGS. 3, and 4, the lock arm 12 formed on the upper surface 11*a* of the first housing 11 may be configured such that a plurality of bar-shaped arms are each disposed on a single plane, and an end part of each of the arms connects to the upper surface 11*a* of the first housing 11 via a leg so as to be integral to the first housing 11.

The lock arm 12 may be configured such that its rear side is disposed with an operating part 14 formed with an operating knob 144 as a pressing part to be pressed, and its front side is disposed with a locking part 15 formed with a locking piece 154 that directly engages with the locking projection 22.

The operating part 14 may include the operating knob 144, an operating part supporting arm 141, and a left and right pair of operating part coupling arms 143*a* and 143*b*. The operating knob 144 is disposed on the rear side of the lock arm 12. The operating part supporting arm 141 extends forward from a center of the operating knob 144. The left and right pair of operating part coupling arms 143*a* and 143*b* respectively extend forward from both end parts in the width direction of the operating knob 144. The operating part coupling arms 143*a* and 143*b* will sometimes be generally referred to as the operating part coupling arms 143.

The operating knob 144 may be formed in a flat plate shape having a width wider than a width within which an operating part leg 142 and a pair of locking part legs 152*a* and 152*b*, described later, are disposed in the width direction.

Figure 5:
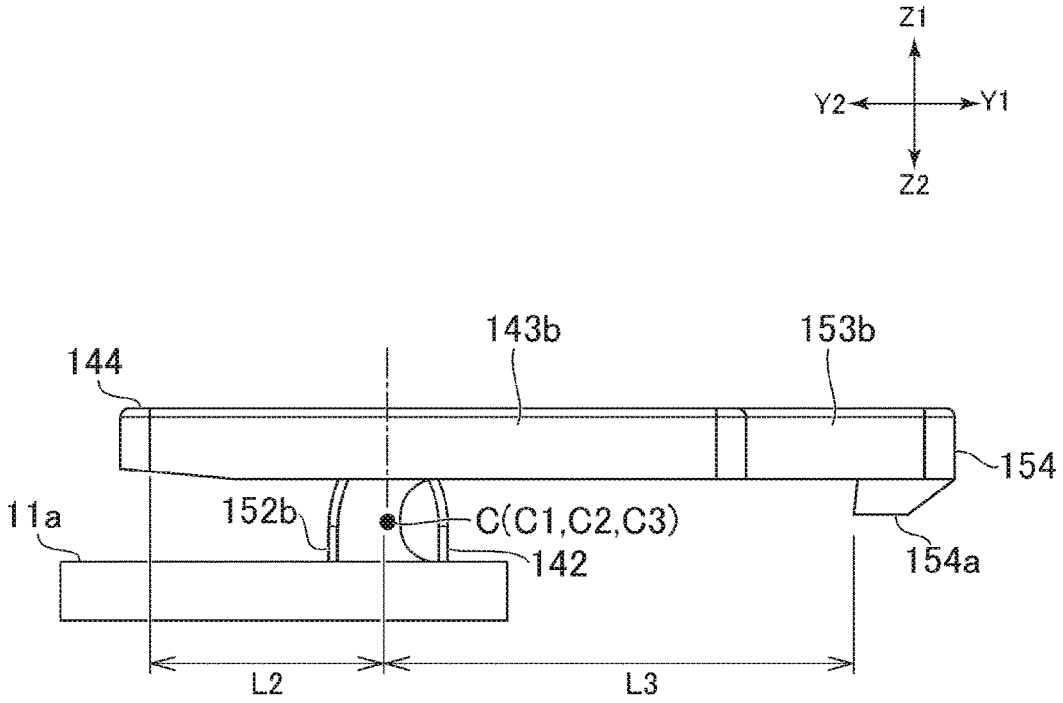
FIG. 5 is a side view of the lock arm representing the lock structure of the connector according to the present disclosure.
Figure 6:
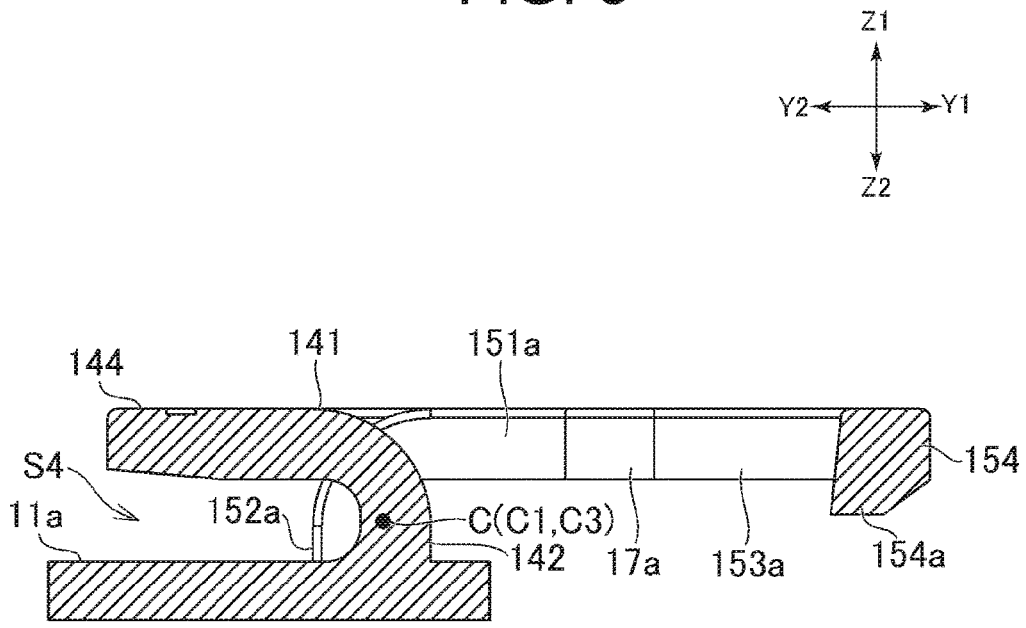
FIG. 6 is a cross-sectional view of the lock arm taken along line VI-VI illustrated in FIG. 4.

As illustrated in FIGS. 5 and 6, the operating part supporting arm 141 is an arm that is formed in an approximately square column shape having a thickness approximately identical to a thickness of the operating knob 144 in the up-down direction. The arm extends forward from the center of the operating knob 141. The arm has a front end part connected to the upper surface 11*a* of the first housing 11 via the operating part leg 142. The operating part leg 142 may be formed to expand and widen in the front-rear direction around the upper surface 11*a* so that its base keeps enough strength. The operating part leg 142 may also be formed to extend upward from the upper surface 11*a* of the first housing 11. The operating part leg 142 may further be formed to bend rearward to connect to the operating part supporting arm 141. Between the upper surface 11*a* and the operating knob 144, a space S4 may be provided so that, when the operating knob 144 is pressed downward, the lock arm 12 swings and the locking piece 154 disengages from the locking projection 22.

As illustrated in FIG. 4, the operating part supporting arm 141 and the operating part leg 142 lie, in the width direction, between the locking part supporting arms 151*a* and 151*b* of the locking part 15, described later, specifically, between the locking part legs 152*a* and 152*b*. The operating part supporting arm 141 and the operating part leg 142, as well as the locking part supporting arms 151 and the locking part legs 152, have an identical thickness. However, a width of each of the operating part supporting arm 141 and the operating part leg 142 is formed wider than a width of each of the locking part supporting arms 151 and the locking part legs 152 for increased stiffness.

The operating part coupling arms 143*a* and 143*b* may be arms formed in an approximately square column shape having a thickness approximately identical to a thickness of the operating knob 144 in the up-down direction. The operating part coupling arms 143*a* and 143*b* may respectively extend forward from both end parts of the operating knob 141. The operating part coupling arms 143*a* and 143*b* may respectively come outside the locking part supporting arms 151*a* and 151*b* of the locking part 15, described later, to couple to locking part coupling arms 153*a* and 153*b* via coupling parts 16*a* and 16*b*. In other words, the operating part 14 and the locking part 15 may be integrally formed. In the embodiment, the lock arm 12 may be formed in a left-right symmetry shape, while the operating part coupling arms 143*a* and 143*b* may each be formed to have an identical width and an identical thickness in the left-right direction, i.e., may be identical in size.

As illustrated in FIGS. 3 and 4, the locking part 15 may be formed so that the locking piece 154 extending in the left-right direction to have a square column shape is provided at a front end part of the lock arm 12. As illustrated in FIG. 6, the locking piece 154 includes a projection piece 154*a* projecting longer in thickness than a thickness of each of the locking part coupling arms 153. The projection piece 154*a* is formed so as to come into contact with the upper surface 21*a* of the second housing 21.

As illustrated in FIG. 4, the locking part 15 may be formed with the locking part coupling arms 153*a* and 153*b* and the locking part supporting arms 151*a* and 151*b* . The locking part coupling arms 153*a* and 153*b* respectively extend rearward from both end parts in the left and right width direction of the locking piece 154. The locking part supporting arms 151*a* and 151*b* further extend rearward from the locking part coupling arms 153*a* and 153*b*. The locking part coupling arms 153*a* and 153*b* and the locking part supporting arms 151*a* and 151*b* will sometimes respectively be generally referred to as the locking part coupling arms 153 and the locking part supporting arms 151. Since the lock arm 12 is formed in the left-right symmetry shape, the locking part supporting arms 151*a* and 151*b* have an identical width in the left-right direction, and the locking part coupling arms 153*a* and 153*b* have an identical width in the left-right direction.

As illustrated in FIG. 6, the locking part coupling arms 153 and the locking part supporting arms 151 may be arms formed in an approximately square column shape having a thickness approximately identical to a thickness of the locking piece 154 in the up-down direction. The locking part coupling arms 153*a* and 153*b* and the locking part supporting arms 151*a* and 151*b* may respectively be connected to each other via inclination parts 17*a* and 17*b*, and may be formed so that the locking part supporting arms 151*a* and 151*b* are respectively smaller in width than the locking part coupling arms 153*a* and 153*b*. With such a configuration, stiffness of each of the locking part supporting arms 151 is made lower than stiffness of each of the locking part coupling arms 153.

As illustrated in FIGS. 3 and 4, rear end parts of the locking part supporting arms 151*a* and 151*b* may respectively connect to the upper surface 11*a* of the first housing 11 via the locking part legs 152*a* and 152*b*. The locking part legs 152 may each be formed to expand and widen in the front-rear direction around the upper surface 11*a* so that respective bases keep enough strength. The locking part legs 152 may also be formed to extend upward from the upper surface 11*a* of the first housing 11. The locking part legs 152 may further be formed to bend forward to connect to the rear end parts of the locking part supporting arms 151*a* and 151*b*.

As described above, the operating part supporting arm 141 lies, between the locking part supporting arms 151*a* and

151*b* in the left-right direction, at an inside position rather closer to a center, while the operating part leg 142 lies, between the locking part legs 152*a* and 152*b* in the left-right direction, at a position rather closer to the center to connect to the upper surface 11*a* of the first housing 11. As described above, the lock arm 12 connects to the upper surface 11*a* of the first housing 11 at three locations, i.e., the operating part leg 142 and the locking part legs 152*a* and 152*b*. Compared with a case in the related art in which the lock arm 12 is connected at two locations, connecting the lock arm 12 to the upper surface of the first housing 11 at three locations increases stiffness of the lock arm 12 and a force of keeping the lock arm 12 at an initial position, leading to a higher holding force of the connector. Compared with a case in which two operating part legs are respectively disposed outside the locking part legs 152*a* and 152*b*, disposing the operating part leg 142 within a space between the locking part legs 152*a* and 152*b* in the left-right direction of the lock arm 12 allows effective use of the space, refraining the lock arm 12 from increasing in size in the left-right direction.

As described above, the operating part coupling arms 143*a* and 143*b* may respectively couple to the locking part coupling arms 153*a* and 153*b* via the coupling parts 16*a* and 16*b*. As illustrated in FIG. 3, a frame body F in which the operating knob 144, the operating part coupling arm 143*a*, the locking part coupling arm 153*a*, the locking piece 154, the locking part coupling arm 153*b*, and the operating part coupling arm 143*b* are integral may be formed. The frame body F is set with a predetermined thickness in the up-down direction and a predetermined width in the left-right direction to secure stiffness so that the operating knob 144 does not deform when pressed, but operates properly. The width and the thickness of each of the operating part coupling arms 143 in the left-right direction may respectively be identical to the width and the thickness of each of the locking part coupling arms 153.

As illustrated in FIG. 4, the coupling parts 16*a* and 16*b* may respectively be formed so that, within a connection length L1 in the front-rear direction, at least the locking part coupling arms 153*a* and 153*b* are included, as well as the locking part supporting arms 151*a* and 151*b* and the inclination parts 17*a* and 17*b* are further included. Although the locking part coupling arms 153*a* and 153*b* respectively gradually reduce in width along the inclination parts 17*a* and 17*b*, and connect to the locking part supporting arms 151*a* and 151*b*, stiffness of the frame body F, as described above, can be secured, as long as at least the locking part coupling arms 153*a* and 153*b* and the inclination parts 17*a* and 17*b* are included within the connection length L1, and the connection length L1 is longer than each of the widths of the locking part coupling arms 153*a* and 153*b* (e.g., approximately twice). To reduce the width of each of the locking part coupling arms 153, the inclination parts 17 may not be provided, but steps may be formed on the locking part coupling arms 153. In this case, the connection length L1 of each of the coupling parts 16 may be at least identical to or longer than the width of each of the locking part coupling arms 153 so as not to include the locking part supporting arms 151.

The inclination parts 17*a* and 17*b* are each formed so that a gap W between the inclination parts 17*a* and 17*b* expands toward the locking part legs 152*a* and 152*b*. In other words, a gap between the locking part supporting arms 151*a* and 151*b* and a gap between the locking part legs 152*a* and 152*b* are each formed wider than a gap between locking part coupling arms 153*a* and 153*b*. With this configuration, stiffness of each of the locking part supporting arms 151 can be made lower than stiffness of each of the locking part coupling arms 153. Therefore, the width W of the space in which the operating part supporting arm 141 and the operating part leg 142 are disposed can be expanded. As a result, the operating part supporting arm 141 can be expanded in width so as to be thicker without expanding a total width of the lock arm 12. By expanding in width the operating part supporting arm 141 and the operating part leg 142 so as to be thicker, the lock arm 12 can be connected to the first housing 11 at three locations for further increased stiffness for a further higher holding force of the connector.

As illustrated in FIG. 6, the operating knob 144, the operating part supporting arm 141, and the operating part leg 142 share a swing center C1 at a position between the upper surface 11*a* of the first housing 11 and a lower surface of the operating knob 144 in the up-down direction and rather rearward from a center position of the operating part leg 142 in the front-rear direction. As illustrated in FIGS. 5 and 6, the locking piece 154, the locking part coupling arms 153, the locking part supporting arms 151, and the locking part legs 152 share swing centers C2 and C3 respectively at positions rather forward from a center position of each of the locking part legs 152. When viewed from a side, as illustrated in FIG. 5, the operating part leg 142 and the left and right locking part legs 152*a* and 152*b* are disposed so as to overlap with each other. The arrangement positions with respect to the swing center C1 and the swing centers C2 and C3 in the front-rear direction are approximately identical to each other. Therefore, the swing centers C1, C2, and C3 function as a single swing center C for the whole lock arm 12. A distance L2 between the operating knob 144 and the swing center C may be shorter than a distance L3 between the locking piece 154 and the swing center C. The swing center C may be disposed rearward than the coupling parts 16*a* and 16*b*. With this configuration, the frame body F and the locking piece 154 can move greater in accordance with a press operation of the operating knob 144. Therefore, the locking projection 22 can securely be disengaged.

Next, insertion and extraction operations of and a holding force between the above described first connector 10 and the above described second connector 20 will now be described herein.

When the second connector 20 is inserted into the first connector 10, the projection piece 154*a* formed on the locking piece 154 rides up the inclined surface of the locking projection 22. Accordingly, the lock arm 12 swings about the swing center C from the initial position. When the locking piece 154 rides over the locking projection 22 and lies in front of the locking projection 22, the lock arm 12 returns to the initial position. Therefore, the locking piece 154 and the locking projection 22 overlap to each other in the up-down direction, i.e., engage with each other. As described above, when the lock arm 12 engages with the locking projection 22, the first connector 10 and the second connector 20 fit and lock to each other. While the locking projection 22 and the lock arm 12 engage with each other, i.e., lock to each other, even when the first connector 10 and the second connector 20 are moved so as to disengage from each other, a rear surface of the locking piece 154 including the projection piece 154*a* comes into contact with a front surface of the locking projection 22, i.e., the rear surface is restricted from moving relative to the front surface, preventing the first connector 10 and the second connector 20 from coming off each other.

At this time, the operating part supporting arm 141 and the operating part leg 142 each expanded in width and increased in stiffness can increase a force of securing the lock arm 12 at the initial position, improving a holding force. As described above, the lock arm 12 is connected to the first housing 11 via the operating part leg 142 in addition to the locking part legs 152*a* and 152*b*. Therefore, even when the first connector 10 and the second connector 20 locked to each other are forcibly separated, and the locking piece 154 is pulled by the locking projection 22, a load applied to the lock arm 12 can be dispersed to the legs, improving the holding force.

To unlock the first connector 10 and the second connector 20, the operating knob 144 is pressed. When the operating knob 144 is pressed, the lock arm 12 swings about the swing center C so that the locking piece 154 rises. At this time, the stiffness of the frame body F, which is greater than the stiffness of the locking part supporting arms 151, allows the whole frame body F to swing in accordance with the operation of the operating knob 144. Therefore, the locking piece 154 rises higher than the locking projection 22 for disengagement. In a case where the stiffness of the frame body F is lower than the stiffness of the locking part supporting arms 151*a* and 151*b*, the operating part coupling arms 143 might deform when the operating knob 144 is pressed. In this case, the locking piece 154 configuring the frame body might not rise higher than the locking projection 22. As a result, the engagement might not be released. To solve this problem, as described above, the stiffness of the frame body F has been made higher than the stiffness of the locking part supporting arms 151 and the locking part legs 152 to securely achieve disengagement.

Further, in the embodiment, a width of each of the locking part supporting arms 151 and each of the locking part legs 152 has been reduced to expand the gap W between a pair of the locking part supporting arm 151*a* and the locking part leg 152*a* and a pair of the locking part supporting arm 151*b* and the locking part leg 152*b*. A width of the operating part supporting arm 141 and the operating part leg 142 is also expanded to increase its stiffness than the stiffness of the locking part supporting arms 151 and the locking part legs 152. Therefore, the stiffness of the operating part supporting arm 141 and the operating part leg 142 can be increased without expanding the total width of the lock arm 12.

The locking part coupling arms 153 are included within the connection length L1 extending in the front-rear direction of each of the coupling parts 16*a* and 16*b* respectively connecting the right and left operating part coupling arms 143*a* and 143*b* and the right and left locking part coupling arms 153*a* and 153*b*. In addition, the connection length L1 is at least set identical to or longer than each of the widths of the locking part coupling arms 153*a* and 153*b*. Therefore, the stiffness of the frame body F can be further increased.

The present disclosure illustrates merely examples. For example, the lock arm 12 disclosed in the embodiment is formed in a left-right symmetry shape, while the operating part coupling arms 143*a* and 143*b*, the locking part supporting arms 151*a* and 151*b*, and the locking part coupling arms 153*a* and 153*b*, for example, are each formed in an identical shape to respectively configure pairs. However, even when the arms configure pairs, each of the pairs may not be necessarily formed in an identical shape or a symmetry shape. Note that any appropriate change that preserves the gist of the present disclosure and can easily be conceived by a person skilled in the art is within the scope of the present disclosure. Furthermore, the width, thickness, shape, and the like of each part illustrated in the drawings are schematically expressed, and are not limited to the interpretation of the present disclosure.

The invention claimed is:

1. A connector including a lock arm configured to engage with a locking projection provided on a target connector to be inserted and extracted to lock the target connector when fitted, the connector comprising:

a housing provided with the lock arm; and a terminal accommodated in the housing for connection to a terminal of the target connector, wherein the lock arm includes:

a locking part including an engaging part to be engaged with the locking projection of the target connector; and an operating part including a pressing part to be pressed, the locking part further includes:

a pair of locking part coupling arms each extending from the engaging part in a separation direction of the target connector;

a pair of locking part supporting arms each further extending from the pair of locking part coupling arms in the separation direction of the target connector; and a pair of locking part legs connecting an outer surface of the housing and the pair of locking part supporting arms, the operating part further including:

a pair of operating part coupling arms extending from the pressing part in a direction toward the target connector, the pair of operating part coupling arms respectively connecting to the pair of locking part coupling arms;

an operating part supporting arm connected to the pressing part, the operating part supporting arm extending from between the pair of operating part coupling arms in the direction toward the target connector; and an operating part leg connecting the outer surface of the housing and the operating part supporting arm, the operating part leg is disposed, on the outer surface of the housing, between the pair of locking part legs, and the pair of operating part coupling arms are respectively disposed outside the pair of locking part supporting arms.

2. The connector according to claim 1, wherein the operating part supporting leg and the operating part supporting arm are respectively formed thicker than the locking part legs and the locking part supporting arms.

3. The connector according to claim 1, wherein the pair of locking part coupling arm parts and the pair of operating part coupling arms are formed thicker than the pair of locking part supporting arms.

4. The connector according to claim 1, wherein the locking part coupling arms and the locking part supporting arms are connected to each other such that the locking part supporting arms are thinner than the locking part coupling arms, and, as for the operating part coupling arms and the locking part coupling arms, the locking part coupling arms are connected to coupling parts each having a length equal to or longer than a width of each of the locking part coupling arms in insertion and extraction directions toward which the target connector is inserted and extracted.

5. A connector assembly comprising:

a first connector; and a second connector, wherein the first connector and the second connector are inserted into and extracted from each other, the first connector is the connector according to any one of claims 1 to 4 including a lock arm configured to engage with a locking projection provided on the second connector to lock the second connector when fitted, and the second connector includes:

a terminal to be connected to a terminal of the first connector; and a second housing provided with the locking projection, the second housing accommodating the terminal of the second connector.

* * * * *